US006003793A

United States Patent [19]

Mann

[11] Patent Number: 6,003,793

[45] Date of Patent: Dec. 21, 1999

[54] BOUNDARY LAYER COAL NOZZLE ASSEMBLY FOR STEAM GENERATION APPARATUS

[76] Inventor: Jeffrey S. Mann, Apt. F-33, Mill Pond Rd., Broad Brook, Conn. 06016

[21] Appl. No.: 08/577,610

[22] Filed: Dec. 22, 1995

[51] Int. Cl.[6] ..... B05B 15/08; F23D 1/00

[52] U.S. Cl. ..... 239/587.5; 110/264

[58] Field of Search ..... 239/587.1, 587.5, 239/587.6, 600; 110/263, 264, 347

[56] References Cited

U.S. PATENT DOCUMENTS

| | | | |
|---|---|---|---|
| 2,895,435 | 7/1959 | Bogot et al. | 110/28 |
| 4,459,922 | 7/1984 | Chadshay | 110/265 |
| 4,520,739 | 6/1985 | McCartney et al. | 110/263 |
| 5,215,259 | 6/1993 | Wark | 239/587.6 |
| 5,249,535 | 10/1993 | Chung | 110/264 |
| 5,435,492 | 7/1995 | Tenerowicz | 239/587.6 |

*Primary Examiner*—Andres Kashnikow
*Assistant Examiner*—Lisa A. Douglas
*Attorney, Agent, or Firm*—Robert S. Smith

[57] ABSTRACT

A steam generating system includes a nozzle for pulverized coal and air which includes an elongated generally cylindrical body having a nozzle at one axial portion thereof. The apparatus also includes a nozzle tip that is generally sleeve shaped and dimensioned to overlap an axial extremity of the body. The tip is mounted for pivotal movement about the extremity of the body and the nozzle tip includes first and second surfaces dimensioned and configured for receiving therebetween all flow from the body. The apparatus also includes a seat plate that is also generally sleeve shaped and dimensioned and configured to provide sealing between the extremity and the nozzle tip. The seal plate is mounted for pivotal movement about the extremity of the body and is dimensioned and configured to have third and fourth surfaces disposed respectively in closely spaced relationship to the first and second surfaces throughout all possible pivotal positions of the seal plate and the nozzle tip. This closely spaced relationship defines an elongated slat for passage of air. The seal plate includes a stop to limit relative pivotal motion between the nozzle tip and the seal plate. The first and second planar surfaces are disposed with the plan thereof parallel to the direction of flow of gases and thus allow the gases to pass through the slot without impediment.

20 Claims, 4 Drawing Sheets

BOUNDARY LAYER COAL NOZZLE ASSEMBLY FOR STEAM GENERATION APPARATUS

The invention relates to coal delivery systems for delivering pulverized coal to coal fired steam generators and more particularly to the construction of the nozzle for delivering the coal. Coal fired furnaces are typically provided with a plurality of ducts or pipes through which pulverized coal is directed to a plurality of fuel-air admission assemblies arrayed in respective vertically extending windboxes. The windboxes are disposed in one or more walls of the furnace and each introduces coal and air into the furnace. The design of such nozzles must consider that the nozzles may be exposed to temperatures well over 1500 degrees Fahrenheit.

The prior art also includes apparatus such as shown in U.S. Pat. No. 5,435,492 for a modular coal nozzle assembly for vapor generation apparatus issued to Ronald J. Tenerowicz and having the same assignee as the present application.

Known nozzle constructions are vulnerable to structural distortion resulting from radiant heat when left out of service for long periods of time. For example, if the the furnace operates at less than peak capacity, not all of the nozzles will function. The nozzles that are not operating are subject to distortion caused by the radiant heat from the furnace. The known nozzle constructions are also vulnerable to structural distortion when coal ignition occurs inside the tip of the coal nozzle. The structural distortion typically results from temperature differentials in the parts of the nozzle caused by radiation of heat generated by combustion within the nozzle.

The problems related to the temperatures around the nozzle are most acute in so called flame attachment nozzles that intentionally maintain the flame near to the nozzle. The problems caused by the high temperatures are also more acute when firing high sulfur and/or high iron content fuels. More specifically, coals having a sulfur content of 1.5% or greater and/or iron outside levels of 10% or greater are particularly a problem. The problems are also accentuated under marginal transport conditions. Such conditions occur, for example, when the hot air fan is too small, the tempering air duct is too small, the mill is not large enough, or the system is operating at high elevations.

When firing high sulfur content and/or high iron content coal under marginal transport conditions, low pressure zones occur at the tip area that results in plane retention of by a fuel and ash buildup. More specifically, the phenomenon known as "plating out" occurs with increasing temperature above the softening temperature of the coal. Thus, continued operation under such conditions leads to distortion of the tip. This distortion affects nozzle performance and service life.

OBJECTS AND SUMMARY OF THE INVENTION

It is an object of the present invention to provide apparatus which will avoid nozzle tip distortions that occur in prior art nozzle constructions.

Another object of the invention is to provide apparatus that will function satisfactorily even with coals having a substantial sulfur and/or iron oxide content.

Still another object of the invention is to provide apparatus that will shield the nozzle tip from the effects of the temperatures present at the nozzle tips.

Yet another object of the invention is to provide apparatus that will sweep away any deposits of slag or ash which may have been deposited inside the nozzle when the nozzle is out of service.

Another object of the invention is to provide apparatus that will be less expensive to manufacture than prior art structures.

It has now been found that these and other objects of the invention may be attained in a steam generating system that includes a nozzle for pulverized coal and air which includes an elongated generally cylindrical body having a nozzle at one axial portion thereof. The apparatus also includes a nozzle tip that is generally sleeve shaped and dimensioned to overlap an extremity of the body. The tip is mounted for pivotal movement about the extremity of the body and the nozzle tip includes first and second surfaces dimensioned and configured for receiving therebetween all flow from the nozzle body. The apparatus also includes a seal plate that is also generally sleeve shaped and dimensioned and configured to provide sealing between the extremity and the nozzle tip. The seal plate is mounted for pivotal movement about the extremity of the body and is dimensioned and configured to have third and fourth surfaces disposed respectively in closely spaced relationship to the first and second surfaces throughout all possible pivotal positions of the seal plate and the nozzle tip. This closely spaced relationship defines an elongated slot for passage of air. The seal plate includes a stop to limit relative pivotal motion between the nozzle tip and the seal plate.

In some forms of the invention the first and second surfaces are planar surfaces. The third and fourth surfaces may be cylindrical sections. The stop may include at least one upstanding member carried on the seal plate. The seal plate may include first and second planar opposed sides joined by the third and fourth surfaces. In some forms of the invention the third and fourth surfaces have concave parts and the concave parts are disposed in opposed relationship.

The stop may be a part of the first and second planar opposed sides and may include at least one ear on each of the first and second sides and in some cases also include a second ear on each of the first and second sides. All of the ears may be generally planar and each of the ears may be coplanar with one of the sides.

BRIEF DESCRIPTION OF THE DRAWING

The invention will be better understood by reference to the accompanying drawing in which.

DESCRIPTION OF THE PREFERRED EMBODIMENT

Figure 1:
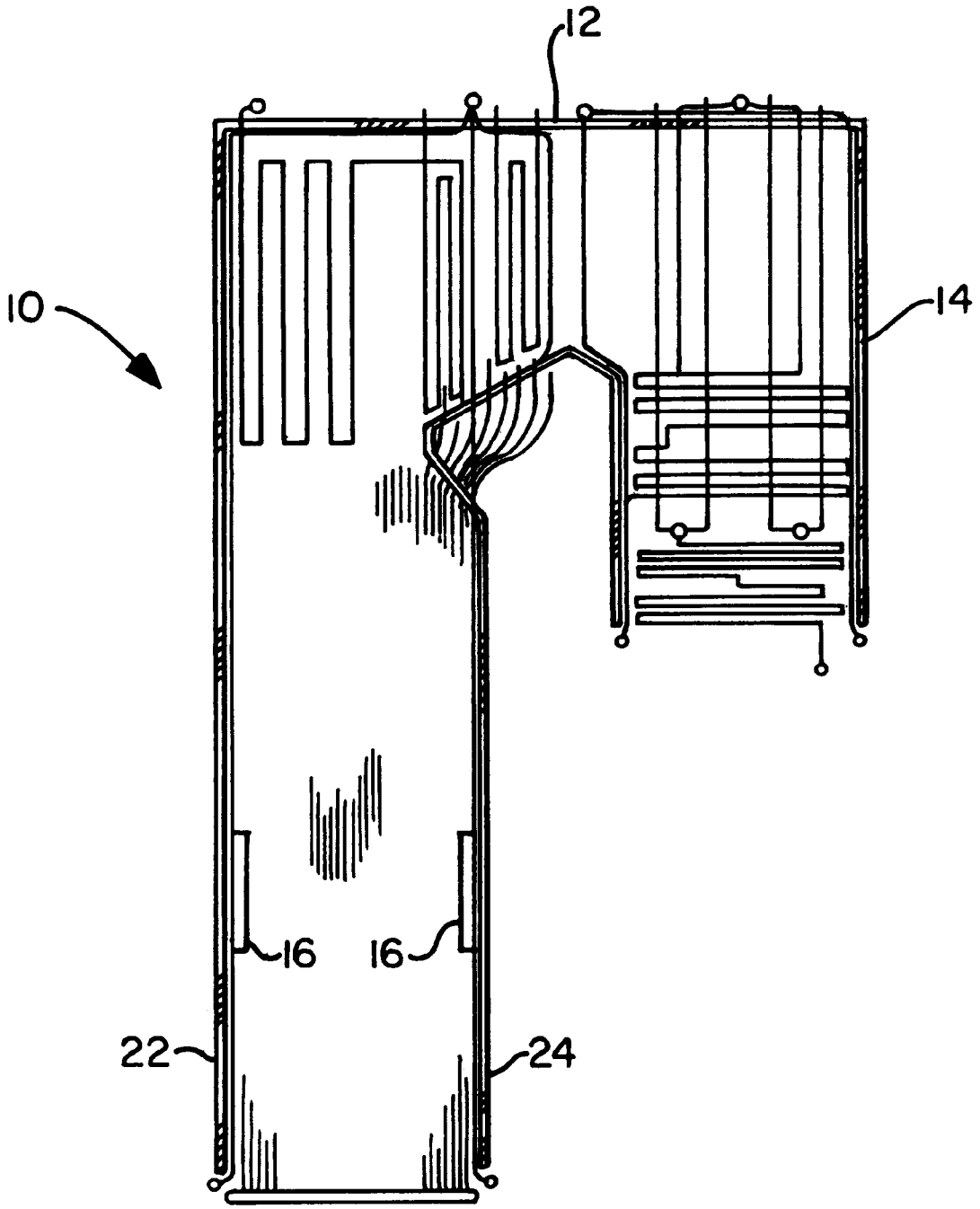
FIG. 1 is a vertical sectional view of a steam generation apparatus of a type in which the present invention has application.

Referring now to FIG. 1 there is shown a furnace 10 that is a type of furnace with which the present invention may be utilized. The furnace 10 is vertically disposed and has an outlet for combustion gases that it's upper end. Extending from this outlet is a lateral gas pass 12 which connects with the upper end of a vertically extended gas pass 14 and a stack (not shown). The illustrated furnace 10 is provided with a burner 16. The furnace 10 has a front wall 22 and a rear wall 24. Side walls (not shown) are disposed in spaced relationship and joined the front wall 22 and the rear wall 24.

Figure 8:
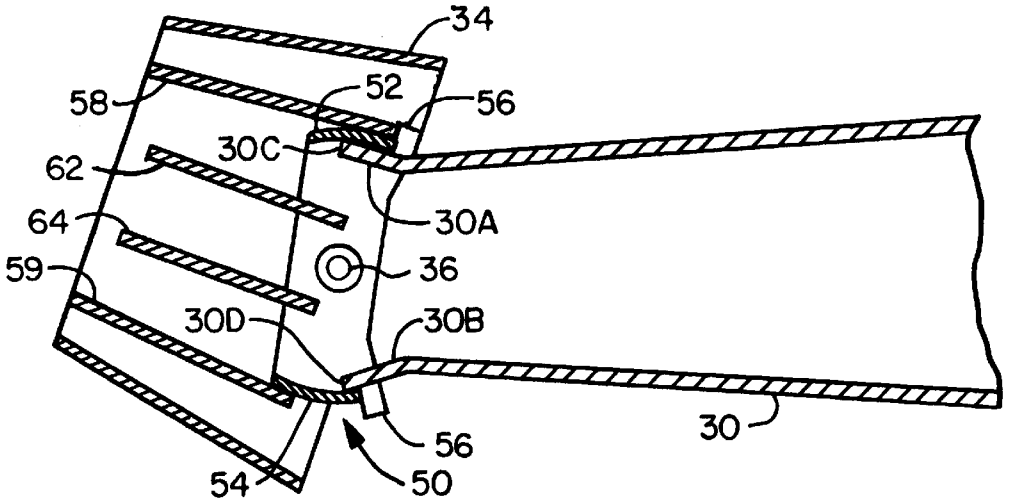
FIG. 8 is a sectional view taken along a vertical plane illustrating the relationship of the parts in a nozzle when the nozzle has traveled to the maximum upward position.
Figure 9:
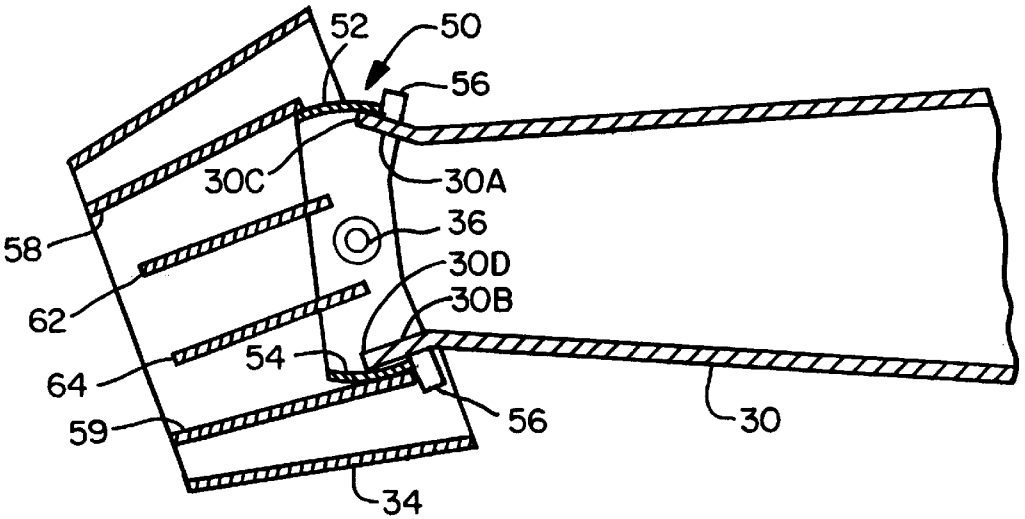
FIG. 9 is a sectional view taken along a vertical plane illustrating the relationship of the parts in a nozzle when the nozzle has traveled to the maximum downward position.

As best seen in FIGS. 8 and 9 it is conventional for a coal nozzle to have an elongated body 30 which carries a nozzle tip 34 mounted for rotatable movement about a pin 36. Typically, the tip 34 is movable between plus or minus twenty-five degrees up or down from an aligned or coaxial relationship between the tip 34 and the body 30. Disposed intermediate the tip 34 and the body 30 is a seal plate. The seal plate 50 in accordance with one form of the present invention is shown in FIGS. 5–9. The seal plate 50 seals the nozzle body 30 with respect to the nozzle tip 34 as the nozzle tip moves throughout the possible range of travel as illustrated in FIGS. 8 and 9.

The nozzle body 30 is provided with an upper horizontal flange 30A and a lower horizontal flange 30B that extend respectively upwardly and downwardly from the body 30. More specifically, the flanges 30A and 30B are diverging generally planar surfaces that are spaced apart from opposite sides of a horizontal plane (not shown) that bisects the body 30. The seal plate 50 includes a first cylindrical section shaped surface 52 and a second cylindrical section shaped surface 54. These surfaces respectively mesh with the free edges 30C, 30D of the flanges 30A and 30B to provide sealing.

A pin 36 supported by a bracket (not shown) attached to the body 30 carries both the nozzle tip 34 and the seal plate 50 for pivotal movement. More particularly, as best seen in FIGS. 8 and 9, the nozzle tip 34 is generally rectangular although the tip may be cylindrical or square in other embodiments. Disposed within the nozzle tip 34 are two generally planar plates 58, 59 that are disposed in closely spaced, substantially tangential relationship to the outer faces respectively of the cylindrical section shaped surfaces 52, 54. More specifically, the plates 58, 59 are respectively spaced about two inches from the cylindrical surfaces 52, 54. This spacing is sufficient to substantially prevent the pulverized coal flowing through the body 30 from passing between the plates 58, 59 and respectively the cylindrical surfaces 52, 54. Accordingly, fluid flow through the body 30 is directed out the tip 34 through only the part of the tip 34 that is intermediate the plates 58, 59. Additional parallel plates 62, 64 are disposed in spaced parallel relationship about the geometric axis of the tip 34. The plates 62, 64 serve to direct the flow through the tip 34 and promote laminar flow.

In operation the nozzle tip 34 is positioned by conventional mechanism (not shown) to a plurality of angular positions throughout the possible 50 degree range of movement thereof. The choice of position is determined by the requirements for optimum combustion. Primary air and coal are forced through the body 30, the central part of the seal plate 52, and the portion of the nozzle tip 34 that is intermediate the plates 58, 59. Secondary air is directed along the exterior surface of the body 30 (1) into the portion of the nozzle tip 34 that is outside the plates 58, 59 and (2) into the two inch high slots intermediate the plates 58, 59 and the seal plate 52. It will be understood that each of the two inch high slot extends the width of the nozzle tip 34. For many applications it will be desirable to direct the secondary air at a higher velocity than the primary air that passes through the body 30. This velocity relationship aids in preventing flame retention when the secondary air is flowing at a velocity greater than the flame propagation velocity. The direction of the secondary air into the slots produces a boundary layer of air on the inner face of the plates 58, 59 which protects these plates from erosion resulting from the massive quantities of pulverized coal that are directed through the nozzle tip 34.

In the preferred embodiment the seal plate 50 is provided with first and second ears at the axial extremities of the cylindrical section shaped surface 52. In addition the seal plate 50 is also provided with first and second ears at the axial extremities of the cylindrical section shaped surface 54. The illustrated preferred embodiment includes generally planar ears or ear shaped stop members 56. Those skilled in the art will recognize that in other embodiments of the invention the stop members may be L-shaped pieces, round pegs, square blocks or any of numerous other shapes.

FIG. 8 illustrates the nozzle tip 34 disposed to direct flow in the maximum upward position. It will be seen that secondary flow directed axially along the exterior surface of the body 30 passes into the regions respectively inside of the plates 58, 60 disposed inside the nozzle tip 34 generally planar ears or ear shaped stop members 56 cause essentially no impediment to flow of secondary air along the outer surface of the body 30 and (1) into the portion of the nozzle tip 34 that is outside the plates 58, 60 and (2) into the two inch high slots intermediate the plates 58, 60 and the seal plate 52.

As is apparent from FIG. 8, generally planar ears or ear shaped stop members 56 at the axial extremities of the cylindrical section shaped surface 52 abut the edge of the plate 58 when the nozzle tip 34 is rotated to the maximum up position. It will thus be seen that the mechanism (not shown) that causes rotation of the nozzle tip 34 causes the seal plate to travel along the flange 30A until the edge of the seal plate reaches the throat of the body 30. The travel of the seal plate 50 is, of course, a rotation about the pin 36 which engages the aligned holes 60, 60 in the respective side walls 61, 61 thereof.

FIG. 9 shows the corresponding engagement between the edge of the plate 60 and generally planar ears or ear shaped stop members 56 disposed at the axial extremities of the cylindrical section shaped surface 54 when the nozzle tip 34 is positioned to direct flow in the maximum downward position.

Figure 3:
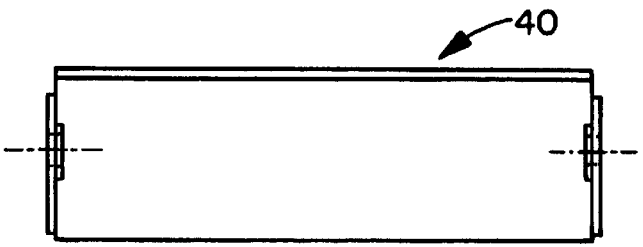
Fig. 3 (PRIOR ART)
FIG. 3 is a plan view of the prior art seal plate shown in FIG. 2.
Figure 2:
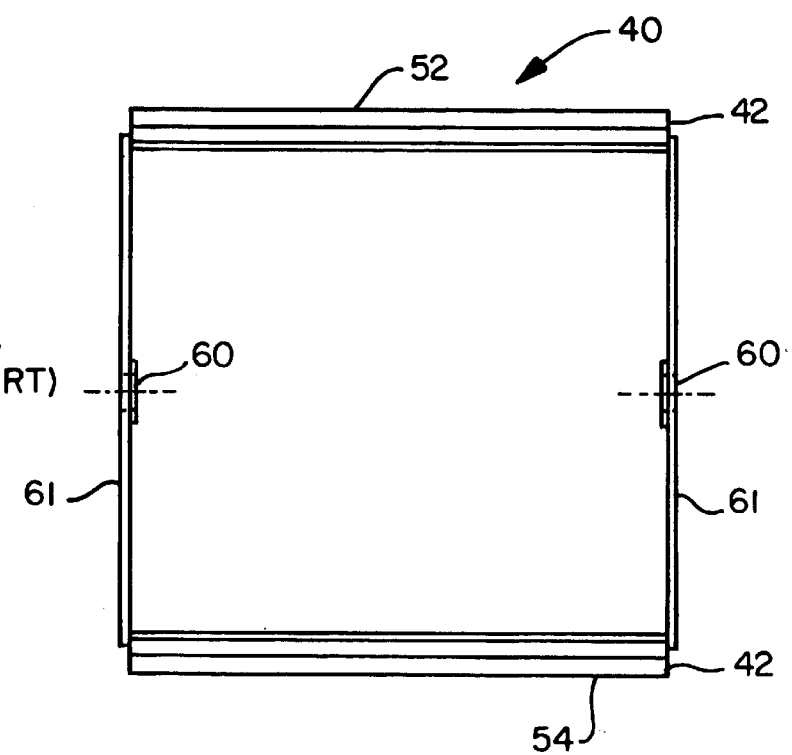
Fig. 2 (PRIOR ART)
FIG. 2 is a front view of a prior art seal plate.
Figure 4:
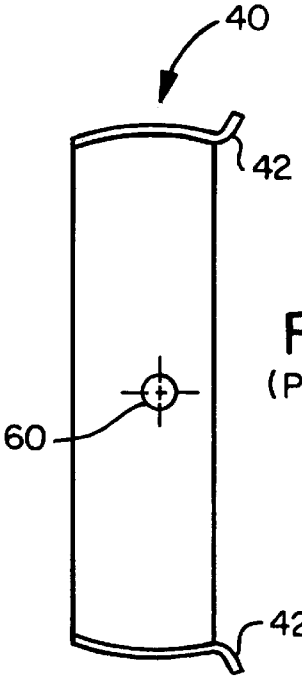
Fig. 4 (PRIOR ART)
FIG. 4 is a side view of the prior art seal plate shown in FIG. 2.
Figure 6:
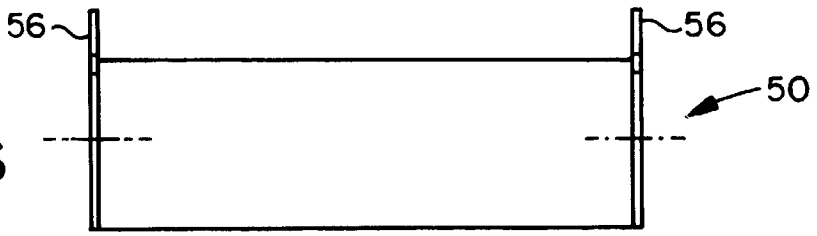
FIG. 6 is a plan view of the seal plate shown in FIG. 5.
Figure 5:
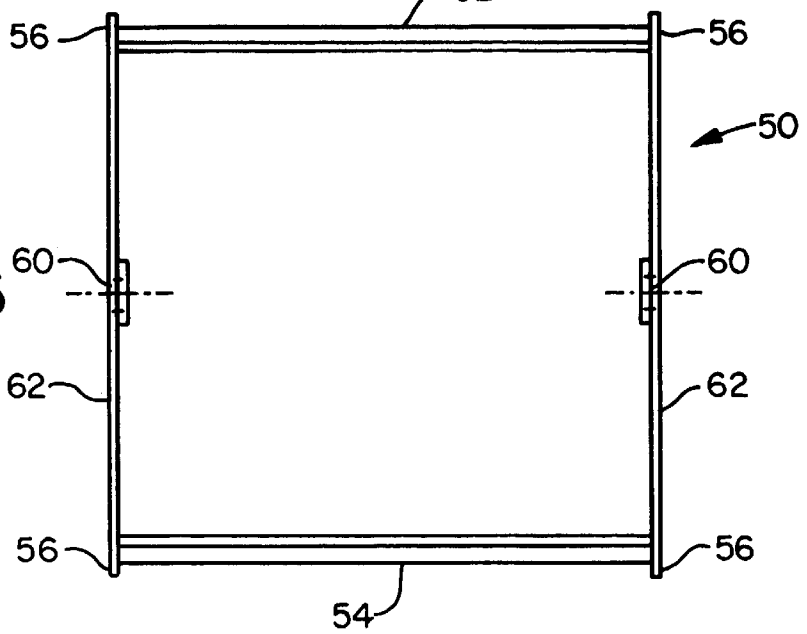
FIG. 5 is a front view of the seal plate in accordance with one form of the present invention.
Figure 7:
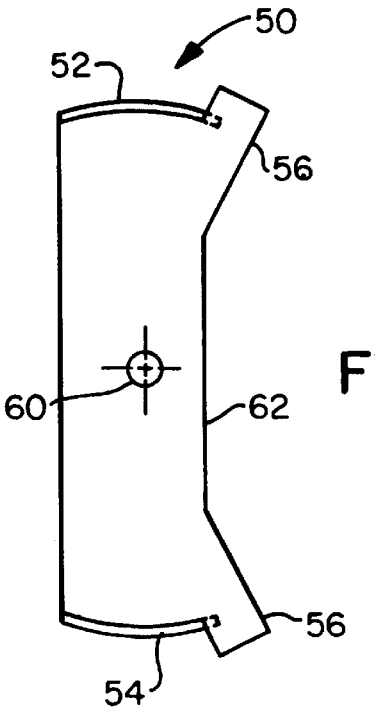
FIG. 7 is a side view of the seal plate shown in FIG. 5.

The present invention is seemingly a small change from the prior art shown in FIGS. 2–4. However, the change produces a very important benefit. The seal plate 40 differs from the seal plate 50 in that the latter does not include generally planar ears or ear shaped stop. Instead the structure has laterally extending lips 42 extending along one edge of respective the cylindrical section shaped surface 52 and the cylindrical section shaped surface 54. These lips 42, 42 have now been found to obstruct the flow of secondary air along the outer surface of the body 30 and thus do not produce the results that are achieved with the apparatus in accordance with the present invention. Advantageously, the apparatus in accordance with the present invention may be manufactured more inexpensively than the prior art apparatus illustrated in FIGS. 2–4. This follows because the structure of the present invention requires less material and requires less fabrication time and expense.

A particular advantage of the present invention is that no changes need to be made to the prior art nozzle tip 34 to achieve the beneficial results of the present invention. Thus the present invention may be retrofitted easily on existing equipment and future production may be easily modified. The present invention advantageously produces a boundary layer that protects the nozzle structure both from heat as well as the erosion caused by the tons of pulverized coal that passes through such apparatus.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention, I claim:

1. A nozzle apparatus for use with an associated steam generating system which comprises:

an elongated generally cylindrical body having a nozzle at one axial portion thereof;

a nozzle tip, said nozzle tip being generally sleeve shaped and being dimensioned to overlap an extremity of said body, said nozzle tip being mounted for pivotal movement about said extremity of said body, said nozzle tip including first and second surfaces dimensioned and configured for receiving therebetween all flow from said body, and a seal plate, said seal plate being generally sleeve shaped and dimensioned and configured to provide sealing between said extremity and said nozzle tip, said seal plate being mounted for pivotal movement about said extremity of said body, said seal plate being dimensioned and configured to have third and fourth surfaces thereof disposed respectively in closely spaced relationship to said first and second surfaces throughout all possible pivotal positions of said seal plate and said nozzle tip to define an elongated slot that allows passage of fluids to create respective boundary layers along said first and second surfaces, said seal plate including a stop to limit relative pivotal motion between said nozzle tip and said seal plate.

2. The apparatus as described in claim 1 wherein:

said first and second surfaces are planar surfaces.

3. The apparatus as described in claim 2 wherein:

said third and fourth surfaces are cylindrical sections.

4. The apparatus as described in claim 3 wherein:

said stop includes at least one upstanding member carried on said seal plate.

5. The apparatus as described in claim 4 wherein:

said seal plate includes first and second planar opposed sides joined by said third and fourth surfaces.

6. The apparatus as described in claim 5 wherein:

said third and fourth surfaces have concave parts and said concave parts are disposed in opposed relationship.

7. The apparatus as described in claim 6 wherein:

said stop is a part of said first and second planar opposed sides.

8. The apparatus as described in claim 7 wherein:

said stop includes at least one ear on each of said first and second sides.

9. The apparatus as described in claim 8 wherein:

said stop includes a second ear on each of said first and second sides.

10. The apparatus as described in claim 9 wherein:

all of said ears are generally planar.

11. The apparatus as described in claim 10 wherein:

each of said ears are coplanar with one of said sides.

12. A steam generating system which comprises:

a furnace;

at least one nozzle apparatus, said nozzle apparatus including an elongated generally cylindrical body having a nozzle at one axial portion thereof;

a nozzle tip, said nozzle tip being generally sleeve shaped and being dimensioned to overlap an extremity of said body, said nozzle tip being mounted for pivotal movement about said extremity of said body, said nozzle tip including first and second surfaces dimensioned and configured for receiving therebetween all flow from said nozzle body, and a seal plate, said seal plate being generally sleeve shaped and dimensioned and configured to provide sealing between said extremity and said nozzle tip, said seal plate being mounted for pivotal movement about said extremity of said body, said seal plate being dimensioned and configured to have third and fourth surfaces thereof disposed respectively in closely spaced relationship to said first and second surfaces throughout all possible pivotal positions of said seal plate and said nozzle tip to define an elongated slot that allows passage of fluids to create respective boundary layers along said first and second surfaces, said seal plate including a stop to limit relative pivotal motion between said nozzle tip and said seal plate, said stop being disposed away from said elongated slot.

13. The apparatus as described in claim 12 wherein:

said first and second surfaces are planar surfaces.

14. The apparatus as described in claim 13 wherein:

said third and fourth surfaces are cylindrical sections.

15. The apparatus as described in claim 14 wherein:

said stop includes at least one upstanding member carried on said seal plate.

16. The apparatus as described in claim 15 wherein:

said seal plate includes first and second planar opposed sides joined by said to third and fourth surfaces.

17. The apparatus as described in claim 16 wherein:

said third and fourth surfaces have concave parts and said concave parts are disposed in opposed relationship.

18. The apparatus as described in claim 17 wherein:

said stop is a part of said first and second planar opposed sides.

19. The apparatus as described in claim 18 wherein:

said stop includes at least one ear on each of said first and second sides.

20. The apparatus as described in claim 19 wherein:

said stop includes a second ear on each of said first and second sides.

* * * * *